US005417917A

United States Patent [19]

Takahar et al.

[11] Patent Number: 5,417,917

[45] Date of Patent: May 23, 1995

[54] METALLIC POROUS MEMBRANE AND METHOD OF MANUFACTURE

[75] Inventors: Kuniyoshi Takahar, Kanagawa; Kiyoshi Fukuura, Yamagata, both of Japan

[73] Assignee: Nihon Millipore Kabushiki Kaisha, Tokyo, Japan

[21] Appl. No.: 54,928

[22] Filed: Apr. 28, 1993

[30] Foreign Application Priority Data

Sep. 4, 1991 [JP] Japan ..... 3-250220

[51] Int. Cl.[6] ..... B01D 24/00; B01D 39/00; B22F 3/16

[52] U.S. Cl. ..... 419/2; 419/53; 419/58; 264/65; 210/510.1

[58] Field of Search ..... 419/2, 19, 22, 29, 45, 419/53, 57, 58; 210/510.1; 264/65

[56] References Cited

U.S. PATENT DOCUMENTS

| | | | |
|---|---|---|---|
| 1,919,730 | 7/1933 | Koenig et al. | 419/2 |
| 2,122,053 | 7/1938 | Burkhardt | 210/510.1 |
| 3,762,920 | 10/1973 | Singer et al. | 75/208 |
| 4,604,259 | 8/1986 | Whitman | 75/247 |
| 4,836,980 | 7/1989 | Kashiwadani | 419/36 |
| 4,996,022 | 2/1991 | Shindo et al. | 419/2 |
| 5,114,447 | 5/1992 | Davis | 55/485 |
| 5,312,582 | 5/1994 | Donado | 419/19 |

FOREIGN PATENT DOCUMENTS

| | | |
|---|---|---|
| 62-287027 | 12/1987 | Japan . |
| 3-56631 | 3/1991 | Japan . |

OTHER PUBLICATIONS

Ownby, P. D., et al., "Final Sintering of $Cr_2O_3$"J. Am. Ceramic Soc. 55(9): 433–436 (1972).

Hagel, W. C., et al., "Initial Sintering of $\alpha$–$Cr_2O_3$", J. Am. Ceramic Soc. 49(1): 23–26 (1966).

Neve, J. M., et al., "Initial Sintering of $Cr_2O_3$", J. Am. Ceramic Soc.–Discussions and Notes 57(6): 274–275 (1974).

Katayama, H. G. "The Hydrogen Reduction Kinetics of Chromic Oxide Pellet," J. Japan Inst. Metals 50(11):993–998(1986).

Callister, W. D. et al., "Sintering Chromium Oxide with the aid of $TiO_2$, "J. Am. Ceram. Soc. 62(3–4):208–211 (1979).

Huppmann, W. J., "Cold Isostatic Pressing of Stainless Steel Filter Cathridges," 579–588.

Tracey, V. A., "Effect of Sintering Conditions on Structure and Strength of Porous Nickel, "Powder Mettalurgy 2:45–48 (1979).

Tracey, V. A., "Usage, Manufacture and Properties of Porous Sintering Nickel, " Powder Mettalurgy Int'l 16(4) :167–170 (1984).

*Primary Examiner*—Donald P. Walsh
*Assistant Examiner*—Anthony R. Chi
*Attorney, Agent, or Firm*—Andrew T. Karnakis

[57] ABSTRACT

A method for the preparation of an open cell porous metallic material is provided. The method includes first molding a metal oxide powder into a desired gas-permeable body, then firing the body to obtain a sintered body of metal oxide. Lastly, oxygen is removed from the sintered metal oxide by firing in a reducing atmosphere. In a preferred embodiment, metal oxides such as NiO are combined with polyvinyl alcohol (PVA) and compressed into a molded body which is then air-fired and reduced. Pore sizes of less than 1 $\mu$m are characteristic. Porosity of up to 64 percent has been demonstrated for nickel. In another preferred embodiment, mixed systems of metal alloys are demonstrated. In particular, results are shown for a NiO—$MoO_3$ system.

9 Claims, No Drawings

METALLIC POROUS MEMBRANE AND METHOD OF MANUFACTURE

RELATED APPLICATIONS

This is a continuation of International Application PCT/JP92/01137, with an international filing date of Sep. 4, 1992, which designated the United States, now abandoned.

BACKGROUND OF THE INVENTION

1. Field of the Invention

The present invention relates to porous metallic material. More particularly, the present invention relates to a method for the preparation of open cell porous metallic material, which is applicable to filters, electrodes for fuel cells and the like, and other suitable uses.

2. Description of the Prior Art

Several open cell porous materials including those of metals and of ceramics are used to filter various gases and solutions of agents during the production of semiconductors. In particular, the former finds its use in electrodes for cells, alloys for hydrogen storage, and others. The present invention is directed specifically to open cell porous metallic material.

It is difficult to define the requirement for open cell porous metallic material in general, because of its dependence on the use thereof. In the use, however, to which the present invention is intended to be applied, and in which fine particle flow is involved, the requirement includes existence of fine and uniformly distributed micropores, mechanical stability of the material, large pore volume or porosity, etc.

In the prior art, methods have been proposed to prepare open cell porous metallic material, wherein the raw material is provided from a certain metal powder of uniform particle size, or fibers, a binder is then added thereto, and after compression molding, the mixture is thermally treated in a non-oxidative atmosphere at an appropriate temperature to be sintered in part [see Yamagata Prefectural Industrial Technology Center Report, No. 21 (in Japanese); Mizuki et al., Kogyo Zairyo, 30(10), 89 -99 (1982)]. Preparing a metal powder of small particle size, however, is carried out using such method as spraying melted metal, or cutting wire rods and subsequent milling [see e.g. Kinzoku Binran, "Preparation of Powders" Sect.; Japanese Patent Application Kokai Nos. 55-93,701, 56-12,559 and 56-52,146], making the powder expensive. Moreover, because of the large surface area and high risk of ignition entailed in such powders, operation in air such as during molding etc. is difficult. Consequently, there arise problems that utmost care is required in the preparation, and that the cost reaches a large amount. Using powders of larger particle size will result in failure to realize sufficiently fine micropores.

In terms of open cell porous ceramic material, there exist several disadvantages, including a possibility of shedding (peeling off of the material from the surface), and an inability of welding to metals for mounting to their supports. Also the material involves a problem of lower porosity, which plays an important role in the application to filters.

Further, problems also reside in porous polymer membranes, which, while being used widely, typically are of low thermal resistance, of insufficient strength, and unable to weld to metals.

While open cell porous metallic material in the prior art has such disadvantages as stated above, it has several advantages in that it is free from the possibility of shedding, and easily weldable to metals, as compared with porous ceramic material on the one hand, and highly thermally resistant, promising sufficient strength, and again easily weldable to metals, as compared with porous polymers on the other hand. Thus, we have concentrated our study to open cell porous metallic material to have finally contrived a readily practicable method for its preparation in a stable state, as compared with those methods in the prior art.

SUMMARY OF THE INVENTION

As described above, prior methods of sintering metal powders have suffered from expensive costs and difficulties in controlling the preparation processes. Therefore, it is an object of the present invention to provide a novel method for the preparation of open cell porous metallic material, wherein these disadvantages have been overcome.

More particularly, it is an object of the present invention to provide a method to obtain an open cell metallic material of a small pore size, and preferably to obtain that of a high porosity.

According to the present invention, there is provided a method for the preparation of an open cell porous metallic material, characterized in that a powder of a metal oxide is molded, the resulting molded body is fired to obtain a sintered body of metal oxide of gas-permeable porous structure, and the sintered body is fired in a reductive atmosphere, at temperatures below the melting point of metals comprising said metal oxides or alloys thereof. Preferably, the reductive atmosphere comprises gaseous hydrogen.

Alternatively, the present invention provides a method for the preparation of an open cell porous metallic material, characterized in that a powder of a metal oxide is molded, the resulting molded body is reduced in a reductive atmosphere, at temperatures below the melting point of metals comprising said metal oxides or alloys thereof.

DETAILED DESCRIPTION OF THE INVENTION

The method according to the present invention enables one to obtain an open cell porous metallic material. It also enables one to decrease the raw material cost, because the oxide powders of fine particles are readily available as raw materials.

The sintered material of metal oxides of gas-permeable porous structure to be reduced in accordance with the present invention is obtained by homogeneously mixing suitable raw material powders with a binder of poly(vinyl alcohol), butyral resin, acrylic resin or the like. Examples of such binders are commercially available in Japan under the following tradenames: PVA degree of polymerization 2000 sold by Wako K.K., PVA degree of polymerization 500 sold by Wako K.K., Poval UMR sold by Unichika K.K., Ceramo PB-15 sold by Daiichi Kogyo Seiyaku K.K., Olicox KC1720 sold by Kyoeisha Yushi K.K.Y. The powders comprising one of the metal oxides, such as NiO, $Fe_2O_3$, CuO, CoO, and MoO3 or a mixture thereof, are capable of being sintered to form a single or composite sintered material of oxides. The process includes molding the mixture into a predetermined shape, for example by using molds, followed by sintering the molded body in the air or an inert atmosphere at a predetermined temperature for a predetermined time period. This method readily permits obtaining a sintered material of desired shape. As the pore size and porosity of micropores generally depend on various factors, including the kind of raw material powders used, particle size, granular variation, ratio of binders admixed, firing temperature, and firing time period, sintered material of metal oxide may be provided by properly controlling these factors. The shape of this sintered material defines the shape of the finished sintered metallic material, and as will be well known by those skilled in the art, molding powdered oxides is carried out quite easily, with the shape being retained after sintering.

Alternatively, the molded body of the metal oxide powder may be directly fired in a reducing atmosphere such as hydrogen.

The molded body or the sintered material of metal oxide is subjected to firing in a reductive atmosphere, such as gaseous hydrogen. The temperature and time period of firing are variable depending on the kind of sintered material of metal oxide. In general, the reducing temperature must be set to a given temperature below the melting point of metals comprising the sintered material of metal oxide, so that the metals obtained by the reduction might not flow to fill up the micropores.

The optimum pore size and pore volume, being variable in response to the use, cannot be definitely specified, though a required range of porous structure is made available by selecting suitable parameters as stated in the above conditions. Nevertheless, micropores from as large as several micrometers to as small as some 0.5 μm in pore size can easily be obtained. Such a small size is substantially lower than can be obtained in the prior art open cell porous metallic material.

The following examples are described for illustrative purpose only, and are not intended to limit the scope of the present invention.

EXAMPLES

Sintered Material of Nickel Disk

The typical conditions wherein nickel oxide is employed as a raw material are as follows:

To powdered NiO, 8% by weight of aqueous solution of poly(vinyl alcohol)(PVA) is added in the amount to reach about 0–25% by weight based on NiO, and mixed well, and the mixture is molded in a shape of 70 mm in diameter and about 2 mm thick under a molding pressure of about 30–100 kg/cm$^2$. After about 3 days of drying under an ambient condition, the cast is subjected to firing in the air at about 800°–1,600° C. for about 4–16 hours, to obtain a sintered material of metal oxide of gas-permeable porous structure. Molding pressure of 30 kg/cm$^2$ is the required lowest pressure, while 100 kg/cm$^2$ does not denote the maximum value, but does indicate the limitation imposed by the machine used. Therefore, any higher molding pressure, e.g. 150 kg/cm$^2$ might be possible. One of ordinary skill in the art will be able to determine an operable pressure with only routine experimentation.

The sintered material is then subjected to a reducing treatment, with gaseous hydrogen being introduced at about 600°–800° C. for about 0.5–2 hours. The specific times and temperatures required for an individual product will be clear, as those conditions are demonstrated in the foregoing examples.

Under the above conditions, generally intact products have been experimentally obtained, except that a few defective open cell porous sintered nickel materials have been obtained. However, the method according to this invention is well feasible for the industrial practice by adjusting and controlling the processes. A pore size of around 1 μm is also available with ease.

Sintered Material of Nickel Cylinder

The typical condition wherein nickel oxide is employed as raw material is as follows:

To powdered NiO, 10% by weight of aqueous solution of poly(vinyl alcohol)(PVA) is added in the amount to reach about 0–40% by weight based on NiO, and mixed well, and the mixture is molded in a shape of cylinder having an outer diameter of 17–23 mm and 2–3 mm thick under a molding pressure of about 200–2000 kg/cm$^2$. After about 3 days of drying under an ambient condition, the cast is subjected to firing in the air at about 1,100°–1,700° C. for about 4 hours, to obtain a sintered material of metal oxide of gas-permeable porous structure. The sintered material is then subjected to a reducing treatment, with gaseous hydrogen being introduced at about 600°–1,000° C. for about 0.5–6 hours. 100% intact products have been experimentally obtained.

Now, several of the preferred embodiments according to the method of the present invention will be described in the following, wherein average pore size and air flow were determined using Coulter Porometer (Tradename of TSI Corp., St. Paul, Minn.). Air flow data indicate values measured under an inlet pressure of 1 kg/cm$^2$ and with a pressure difference of 1 kg/cm$^2$. In addition, rate of vacancy (porosity) was calculated from weight, apparent volume, and net specific gravity of Ni. Porosity was calculated by assuming complete reduction of the oxide to metal.

Regarding yield (rate of intact product), the term "intact product" as used herein is defined as those being distorted to a slight degree to enable mounting on the holders for measuring pore size distribution and air flow, and having no fissure which is observable with the naked eye.

"Rate of shrinkage" as a measure for sinterability means the rate of decrease in diameter of the oxide mass when sintered.

"Rate of weight loss" is used as a measure for reducibility. For example, when all oxygen atoms are released from nickel oxide, the rate of weight loss will be 21.4%.

Example 1(disk)

Sintered metallic material of open celled porous structure was prepared under various conditions each having a set of parameters as listed in Table 1. In order to remove coarse grains from the NiO/PVA mixture, a 30 mesh sieve was used.

TABLE 1

| Sample | PVA/NiO | Press. Kg/cm$^2$ | Fir. Temp °C. | Fir. Time hr | Red. Temp °C. | Red. Time hr |
|---|---|---|---|---|---|---|
| 1 | 1/4 | 33 | 1000 | 4 | 600 | 2 |
| 2 | 1/4 | 82 | 1000 | 16 | 800 | 0.5 |
| 3 | 1/4 | 33 | 1150 | 4 | 800 | 0.5 |
| 4 | 1/4 | 82 | 1150 | 16 | 600 | 2 |
| 5 | 1/10 | 33 | 1000 | 4 | 600 | 0.5 |
| 6 | 1/10 | 82 | 1000 | 16 | 800 | 2 |
| 7 | 1/10 | 33 | 1150 | 4 | 800 | 2 |
| 8 | 1/10 | 82 | 1150 | 16 | 600 | 0.5 |

The average yield for samples obtained was over 50%. The rate of shrinkage during firing, rate of weight loss during reduction, rate of vacancy, average pore size, air flow (1/min·cm²/kg·1/cm²) for each of the intact products are listed in Table 2.

TABLE 2

| Sample | Shrink % | Weight loss % | Porosity % | Ave. pore size μ | Air flow rate |
|---|---|---|---|---|---|
| 1 | 17.4 | 21.3 | 59.7 | 4.49 | 3.53 |
| 2 | 20.4 | 21.4 | 39.5 | 3.99 | 1.45 |
| 3 | 21.7 | 20.6 | 54.3 | 5.84 | 4.93 |
| 4 | 21.7 | 21.8 | 51.7 | 1.98 | 0.61 |
| 5 | 22.3 | 17.3 | 61.8 | 0.57 | 0.85 |
| 6 | 19.6 | 21.5 | 29.2 | 0.4 | 0.19 |
| 7 | 24.6 | 21.4 | 43.8 | 0.91 | 0.83 |
| 8 | 23.0 | 17.2 | 56.7 | 0.4 | 0.46 |

From Table 2, it is shown that sufficient air flow has been achieved as contrasted to the average pore size. It is thus expected this material can be applied for use as filters. Particularly, products of average pore size below 1 μm do not exist among those found in commercially available metallic filters in the prior art, and these products are expected to find many uses.

Incidentally, the fact that the average yield is over 50% makes it probable to obtain excellent products in a high yield by controlling the conditions during firing and reduction, thermal distribution in the oven, posture of samples.

In preparing porous nickel from nickel oxide, sintering proceeds effectively at temperatures above 1,000° C., and so does reduction at temperatures above 600° C. In the case where that the pore size is relatively small, however, reduction seems not to proceed so effectively at 600° C. for 0.5 hours (Sample No. 5, 8).

The factor that most remarkably affected pore size distribution and air flow is the ratio of PVA, followed by the molding pressure.

Example 2

To examine the effect of firing temperature, sets of parameters as listed in Table 3 were employed, with firing temperature being kept constant at 1,600° C. The 30 mesh undersieve was used.

TABLE 3

| Sample | PVA/NiO | Press. Kg/cm² | Fir. Temp °C. | Fir. Time hr | Red. Temp °C. | Red. Time hr |
|---|---|---|---|---|---|---|
| 1 | 1/4 | 33 | 1600 | 4 | 600 | 2 |
| 2 | 1/4 | 82 | 1600 | 16 | 800 | 0.5 |
| 3 | 1/10 | 33 | 1600 | 16 | 600 | 0.5 |
| 4 | 1/10 | 82 | 1600 | 4 | 800 | 2 |

The average yield was about 75%. Results of the determination on intact samples are listed in Table 4.

TABLE 4

| Sample | Shrink % | Weight loss % | Porosity % | Ave. pore size μ | Air flow rate |
|---|---|---|---|---|---|
| 1 | 22.4 | 21.1 | 53.3 | 7.67 | 3.06 |
| 2 | 22.0 | 14.0 | 48.8 | 5.54 | 1.11 |
| 3 | 29.4 | 12.8 | 47.1 | 0.93 | 0.65 |
| 4 | 28.1 | 21.0 | 48.1 | 0.72 | 0.32 |

Table 4 shows that sufficient air flow has been produced as contrasted to average pore size. Also, pore size and air flow were most susceptible to PVA ratio and molding pressure, as found in Example 1, and less susceptible to firing temperature. The firing temperature as a factor affecting pore size and air flow has a different nature from other factors, which act in such a way that, the smaller the pore size becomes, the lesser the air flow becomes. Contrasted with Example 1, while the pore size reaches its minimum and the air flow reaches its maximum at 1,150° C., the former becomes larger and the latter becomes lesser at temperatures in order of 1,000° C. and 1,600° C.

The rate of shrinkage, or the rate of decrease in diameter when fired, is slightly larger than in Example 1. That is, the higher the firing temperature is, the better the sinterability is. PVA ratio also affects the sinterability, indicating that the ratio of 1/10 has better effect than of ¼.

With regard to reducibility, the time period of 30 minutes produces insufficient reducibility even at 800° C., indicating that reducing time has stronger influence than reducing temperature.

Example 3(Disk)

Experiments were carried out using three levels each of the PVA ratio and molding pressure, that had been found to have stronger effect on both pore size and air flow in Examples 1 and 2. Experimental conditions are summarized in Table 5. Effects of filling height (thickness of cast) and sieve (in mesh) were examined as well.

TABLE 5

| Sample | PVA/NiO | Mesh | Fill. height mm | Press. Kg/cm² | Fir. temp. °C. | Fir. time hr | Red. temp. °C. | Red. time hr |
|---|---|---|---|---|---|---|---|---|
| 1 | 0 | 30 | 2 | 33 | 1150 | 4 | 600 | 0.5 |
| 2 | 1/20 | 50 | 2 | 65 | 1150 | 4 | 600 | 0.5 |
| 3 | 1/10 | 100 | 2 | 98 | 1150 | 4 | 600 | 0.5 |
| 4 | 0 | 30 | 3 | 33 | 1150 | 4 | 600 | 0.5 |
| 5 | 1/20 | 50 | 3 | 65 | 1150 | 4 | 600 | 0.5 |
| 6 | 1/10 | 100 | 3 | 98 | 1150 | 4 | 600 | 0.5 |
| 7 | 0 | 30 | 4 | 33 | 1150 | 4 | 600 | 0.5 |
| 8 | 1/20 | 50 | 4 | 65 | 1150 | 4 | 600 | 0.5 |
| 9 | 1/10 | 100 | 4 | 98 | 1150 | 4 | 600 | 0.5 |

The average yield of open celled sintered metallic material obtained was 57%. Results of the determination on the intact samples are shown in Table 6.

TABLE 6

| Sample | Shrink % | Weight loss % | Porosity % | Ave. pore size μ | Air flow rate |
|---|---|---|---|---|---|
| 1 | 25.1 | 19.2 | 58.6 | 0.54 | 0.57 |
| 2 | 24.9 | 20.4 | 52.9 | 0.55 | 0.48 |
| 3 | 23.4 | 20.4 | 53.9 | 0.47 | 0.32 |
| 4 | 25.3 | 19.7 | 52.7 | 0.43 | 0.27 |

TABLE 6-continued

| Sample | Shrink % | Weight loss % | Porosity % | Ave. pore size μ | Air flow rate |
|---|---|---|---|---|---|
| 5 | 24.6 | 18.7 | 52.7 | 0.41 | 0.27 |
| 6 | 24.3 | 18.9 | 58.9 | 0.64 | 0.77 |
| 7 | 24.7 | 15.3 | 49.4 | 0.28 | 0.1 |
| 8 | 25.3 | 18.3 | 55.4 | 0.47 | 0.39 |
| 9 | 24.0 | 18.4 | 55.9 | 0.5 | 0.4 |

Similar tendencies as in Examples 1 and 2 are found concerning the effects of PVA ratio and moulding pressure on pore size and air flow.

Filling height has a direct effect on the thickness of finished samples, thus affecting the air flow to large extent. Mesh value has little effect.

Under the conditions with PVA ratio below 1/10 and firing temperature of 1,150° C., the rate of decrease in diameter amounts to over 23% in every sample, indicating that good sinterability was achieved. Since there exist samples whose of weight loss is high than the theoretical value of 21.4%, reduction at 600° C. for 30 minutes is likely to bring about an insufficient result. The reducibility of sample 7, which is of minimum pore size, is the worst.

Example 4 (Disk)

Experiment 4 was carried out under the conditions as listed in Table 7 with values of PVA ratio not employed in the preceding examples.

TABLE 7

| Sample | PVA/ NiO | Mesh | Fill. height mm | Press. Kg/cm$^2$ | Fir. temp. °C. | Fir. time hr | Red. temp. °C. | Red. time hr |
|---|---|---|---|---|---|---|---|---|
| 1 | 1/6 | 30 | 3 | 49 | 1150 | 4 | 600 | 1 |
| 2 | 1/5 | 30 | 3 | 49 | 1150 | 4 | 600 | 1 |
| 3 | 1/4 | 30 | 3 | 49 | 1150 | 4 | 600 | 1 |

Average yield of over 50% was achieved. Results of determination are shown in Table 8.

TABLE 8

| Sample | Shrink % | Weight loss % | Porosity % | Ave. pore size μ | Air flow rate |
|---|---|---|---|---|---|
| 1 | 20.7 | 20.7 | 64.1 | 0.97 | 0.3 |
| 2 | 20.3 | 20.3 | 61.2 | 1.86 | 2.3 |
| 3 | 21.4 | 20.4 | 61.0 | 3.6 | 3.7 |

It is observed that the transitional change in PVA ratio from 1/6 to ¼ significantly affects pore size and air flow.

The rate of decrease in diameter was around 20%, and, considering the results of other experiments it is understood that, when both temperature and time of firing are constant, there exists a strong correlation between PVA ratio and rate of decrease in diameter.

Even at 600° C., rate of weight loss reached about 20%, if reduction had been carried out for 1 hour.

Other Metals and Alloys

Example 5 (Disk)

A mixed system of various metal oxides was tested principally for sinterability and reducibility. For reference, data were obtained when individual raw material only was employed. Preparing conditions and results of the determination for alloy systems, from which intact sintered metallic material was obtained, are summarized in Tables 9 and 10, respectively. Throughout the experiments, an undersieve of 30 mesh was commonly used, and the same filling height of 3 mm was applied.

PVA ratio was not unified, but selected for appropriate value to make molding easy in the respective cases.

For NiO, $Fe_2O_3$, CoO, and $WO_3$, firing temperature was set to 1,150° C. (the highest temperature in the oven), because of their melting points being higher than 1,300° C. For CuO among the Cu oxides, firing temperature was set to 900° C., because of its melting point being over 1,000° C., and for $Cu_2O$, whose melting point is over 1200° C., but which is converted into CuO in a hot oxidative atmosphere, firing temperature was set to 1,000° C. in Ar atmosphere. While the comparison of sinterability and reducibility between the two showed no significant difference, CuO was used for the mixed system. Regarding Mo oxides, $MoO_3$ was subjected to firing at 500°–600° C. for 24 hours, because of its lower melting point, and $MoO_2$ was subjected to firing at 1,100° C. in Ar atmosphere, because of its tendency to conversion to $MoO_3$ in a hot oxidative atmosphere in spite of melting point.

Both sinterability and reducibility vary depending on the raw material. NiO, $Fe_2O_3$ $WO_3$, $Cu_2O$, CuO showed good sinterability separately.

The sinterability in a mixed system cannot always be predicted. A mixture of NiO and $Fe_2O_3$, each of which showed good sinterability separately, together did not show good sinterability. This result is similar to, for example, NiO—CoO system, in which CoO cannot be separately sintered. In the NiO—$MoO_3$ system, a sample with high NiO content achieved a rate of shrinkage of 7.9%, suggesting that by suitably selecting the parameters for reducing condition, such as temperature, pressure, and atmosphere, sintering using this composition will be possible.

The reducibility of metal oxides separately revealed a tendency similar to that shown by the data in the literatures ("Chemical Encyclopedia"(1963) published by Kyoritsu Shuppansha in Japan, "Oxide Handbook"(1970) published by Nisso Tsushinsha in Japan, for example). While NiO, CoO, and CuO, were sufficiently reduced at 600° C., both $WO_3$ and $MoO_3$ required 1,000° C. $Fe_2O_3$, which had been expected to be sufficiently reducible at 600° C., was reduced insufficiently at that temperature.

The reducibility of mixed system seems to indicate that the only component reducible at a given temperature in its separate state was reduced in the system. NiO—$Fe_2O_3$ and NiO—$WO_3$ systems, insufficiently reducible at 600° C., were well reduced at 800° C. The $MoO_3$—$Cr_2O_3$ system was hardly reduced at 600° C., with $MoO_3$ only being reduced at 1,000° C. $Cr_2O_3$, however, is known to become sinterable either by lowering the partial pressure of oxygen or by elevating the temperature [J. Am. Ceramic Soc., 15(9): 433–436], and to become reducible with hydrogen by elevating the temperature [J. Metal Soc. Japan, 50(11), 993–998 (in Japanese)].

The average yield for an alloy system was found to have a variable value in the range of 30–100% depending on samples, with several of the values being unacceptable. Results of determination of pore size, air flow, etc. on intact samples are shown in Table 10.

TABLE 9

| Sample | Composition | PVA % | Press. Kg/cm$^2$ | Fir. temp °C. | Fir. time hr | Red. temp °C. | Red. time hr |
|---|---|---|---|---|---|---|---|
| 1 | $NiO/Fe_2O_3$ = 2/1 | 0.42 | 65 | 1150 | 4 | 600 | 1 |
| 3 | $CoO/Fe_2O_3$ = 2/1 | 0.30 | 65 | 1150 | 4 | 600 | 1 |
| 5 | NiO/CuO = 9/11 | 0.80 | 65 | | 4 | 600 | 1 |
| 6 | $NiO/WO_3$ = 2/1 | 0.50 | 65 | 9001 | 4 | 800 | 1 |
| 7 | NiO/CuO/ $Fe_2O_3$ = 66/32/2 | 0.54 | 65 | 150 900 | 4 | 600 | 1 |

TABLE 10

| Sample | Shrink % | Porosity % | Ave. pore size μ | Air flow rate |
|---|---|---|---|---|
| 1 | 14.9 | 17 | 1.28 | 2.23 |
| 3 | 11.6 | 27 | 2.24 | 4.63 |
| 5 | 19.0 | 20 | 1.43 | 2.7 |
| 6 | 3.3 | 21 | 2.05 | 5.42 |
| 7 | 20.3 | 21 | 1.63 | 2.86 |

Example 6(Disk)

This example illustrates an example of direct reduction (see Sample 4).

A mixture of nickel oxide and molybdenum oxide was fired in the conditions listed in Table 11 and then reduced. The results are listed in the Table 12. In light of the rate of weight loss, it is noted that not only nickel but also molybdenum are reduced. The samples 1–3 were those obtained by firing in air to obtain sintered bodies and then reduced but the warpage was too large to permit measurement.

TABLE 11

| Sample | Composition | PVA % | Press. Kg/cm$^2$ | Fir. temp °C. | Fir. time hr | Red. temp °C. | Red. time hr |
|---|---|---|---|---|---|---|---|
| 1 | $NiO/MoO_3$ = 0/10 | 1 | 100 | 700 | 4 | 1000 | 0.5 |
| 2 | 8/2 | 1 | 100 | 700 | 4 | 1000 | 0.5 |
| 3 | 8/2 | 1 | 100 | 700 | 4 | 1000 | 0.5 |
| 4 | 8/2 | 1 | 100 | — | — | 1000 | 0.5 |

TABLE 12

| Sample | Shrink % | Weight loss % | Theor. weght loss % | Porosity % | Ave. pore size μ | Air flow rate |
|---|---|---|---|---|---|---|
| 1 | 8.6 | 36.2 | 33.4 | — | — | — |
| 2 | 26.4 | 23.8 | 25.3 | — | — | — |
| 3 | 26.5 | 24.0 | 25.3 | — | — | — |
| 4 | 23.6 | 23.6 | 25.3 | 56.3 | 1.04 | 1.33 |

Example 7(Cylinder)

The steps described in the foregoing as applied to cylinders are followed with the specific conditions listed in Table 13. All samples are intact. The results are shown in Table 14.

TABLE 13

| Sample | Granulation | PVA % | Press. Kg/cm$^2$ | Fir. temp °C. | Fir. time hr | Red. temp °C. | Red. time hr |
|---|---|---|---|---|---|---|---|
| 1 | A | 1 | 500 | 1100 | 4 | 700 | 6 |
| 2 | A | 1 | 500 | 1300 | 4 | 700 | 6 |
| 3 | A | 1 | 500 | 1500 | 4 | 700 | 6 |
| 4 | A | 1 | 500 | 1100 | 4 | 800 | 6 |
| 5 | A | 1 | 500 | 1300 | 4 | 800 | 6 |
| 6 | A | 1 | 500 | 1500 | 4 | 800 | 6 |
| 7 | A | 1 | 500 | 1100 | 4 | 900 | 6 |
| 8 | A | 1 | 500 | 1300 | 4 | 900 | 6 |
| 9 | A | 1 | 500 | 1500 | 4 | 900 | 6 |
| 10 | B | 1 | 500 | 1100 | 4 | 700 | 6 |
| 11 | B | 1 | 500 | 1300 | 4 | 700 | 6 |
| 12 | B | 1 | 500 | 1500 | 4 | 700 | 6 |
| 13 | B | 1 | 500 | 1100 | 4 | 800 | 6 |
| 14 | B | 1 | 500 | 1300 | 4 | 800 | 6 |
| 15 | B | 1 | 500 | 1500 | 4 | 800 | 6 |
| 16 | B | 1 | 500 | 1100 | 4 | 900 | 6 |
| 17 | B | 1 | 500 | 1300 | 4 | 900 | 6 |
| 18 | B | 1 | 500 | 1500 | 4 | 900 | 6 |

Note
A: By mortar.
B: By spray dryer

TABLE 14

| Sample | Shrink % outer diameter | Weight loss % | Porosity % | Aver. size μ | Air flow rate |
|---|---|---|---|---|---|
| 1 | 10.5 | 23.24 | 65.8 | 0.99 | 1.34 |
| 2 | 8.1 | 21.36 | 69.2 | 1.45 | 2.64 |
| 3 | 13.5 | 20.25 | 65.1 | 1.98 | 4.06 |
| 4 | 15.1 | 21.35 | 62.1 | 1.36 | 2.03 |
| 5 | 12.4 | 21.33 | 65.7 | 1.92 | 4.07 |
| 6 | 13.2 | 21.32 | 64.6 | 2.23 | 4.57 |
| 7 | 18.9 | 21.37 | 56.5 | 1.62 | 2.51 |
| 8 | 14.6 | 21.36 | 62.8 | 2.52 | 5.60 |
| 9 | 17.0 | 21.35 | 61.4 | 2.35 | 4.70 |
| 10 | 11.4 | 21.29 | 69.6 | 0.90 | 1.37 |
| 11 | 11.7 | 21.29 | 66.4 | 1.22 | 2.34 |
| 12 | 12.6 | 21.56 | 62.8 | 1.50 | 2.20 |
| 13 | 16.2 | 21.35 | 58.8 | 1.23 | 1.84 |
| 14 | 14.4 | 21.34 | 60.7 | 1.50 | 3.07 |
| 15 | 15.0 | 21.34 | 59.6 | 1.62 | 2.70 |
| 16 | 19.8 | 21.37 | 51.4 | 1.53 | 1.90 |
| 17 | 16.2 | 21.34 | 56.5 | 1.64 | 2.41 |
| 18 | 16.5 | 21.36 | 46.4 | 2.01 | 3.58 |

From the foregoing, it is understood that gas permeable sintered metallic materials can be easily obtained from molded bodies of metal oxides given the teachings contained herein.

It should be understood that the present invention may have a number of modifications fall within the scope and spirit of the present invention. The present invention is only limited by the claims included herein.

We claim:

1. A method for the preparation of an open cell porous metallic material, comprising the steps of: molding a ceramic powder of at least one metal oxide whose metal has a sintering point; sintering the resultant molded body in an oxidizing atmosphere to produce a sintered metal oxide body having a gas-permeable porous structure; and firing said sintered body in a reductive atmosphere at temperatures below the sintering point of the metal comprising said metal oxide or alloy thereof.

2. The method of claim 1 wherein gaseous hydrogen is employed as the reductive atmosphere.

3. The method of claim 1 wherein said at least one metal oxide is selected from the group consisting of metal oxides of Ni, Fe, Cu, Co, Mo and W.

4. The method of claim 3, wherein said at least one metal oxide is nickel oxide.

5. The method of claim 3, wherein said at least one metal oxide is nickel oxide and molybdenum oxide.

6. A porous metallic membrane formed from the reduction of a sintered metal oxide material, said membrane having a porosity of at least about 50% and an open cell matrix of interconnected pores with an average pore size of about 2 microns or less and an air flow rate of at least about 1.8 liters/minute/square centimeter at an inlet pressure of 1 $kg/cm^2$ and with a pressure difference of 1 $kg/cm^2$.

7. The membrane of claim 6 wherein said sintered material is selected from the group consisting of metal oxides of Ni, Fe, Cu, Co, Mo and W.

8. The membrane of claim 7 wherein said sintered material is nickel oxide.

9. The membrane of claim 7 wherein said sintered material is a mixture of nickel oxide and molybdenum oxide.

* * * * *

UNITED STATES PATENT AND TRADEMARK OFFICE

CERTIFICATE OF CORRECTION

PATENT NO. : 5,417,917

DATED : May 23, 1995

INVENTOR(S) : Kuniyoshi Takahara, et al.

It is certified that error appears in the above-indentified patent and that said Letters Patent is hereby corrected as shown below:

On the title page, item [75] Inventor: "Kuniyoshi Takahar" should read--Kuniyoshi Takahara--.

Signed and Sealed this

Twenty-eighth Day of November 1995

*Attest:*

Bruce Lehman

BRUCE LEHMAN

*Attesting Officer*

*Commissioner of Patents and Trademarks*